US005166658A

United States Patent [19]

Fang et al.

[11] Patent Number: 5,166,658

[45] Date of Patent: Nov. 24, 1992

[54] ELECTRICAL DEVICE COMPRISING CONDUCTIVE POLYMERS

[75] Inventors: Shou-Mean Fang, Union City; David A. Horsma; Guillaume Peronnet, both of Palo Alto; Charles H. Camphouse, Mountain View, all of Calif.

[73] Assignee: Raychem Corporation, Manlo Park, Calif.

[21] Appl. No.: 487,985

[22] PCT Filed: Sept. 30, 1988

[86] PCT No.: PCT/US88/03377

§ 371 Date: Mar. 8, 1990

§ 102(e) Date: Mar. 8, 1990

Related U.S. Application Data

[63] Continuation-in-part of Ser. No. 102,987, Sep. 30, 1987.

[51] Int. Cl.[5] ..... H01C 7/10

[52] U.S. Cl. ..... 338/23; 338/22 R

[58] Field of Search ..... 338/22 R, 225 D, 23, 338/25; 337/91

[56] References Cited

U.S. PATENT DOCUMENTS

| | | | |
|---|---|---|---|
| 3,243,753 | 3/1966 | Kohler | 338/31 |
| 3,287,684 | 11/1966 | Armbruster | 338/211 |
| 3,351,882 | 11/1967 | Kohler et al. | 338/322 |
| 3,737,825 | 6/1973 | Summe et al. | 337/91 |
| 3,861,029 | 1/1975 | Smith-Johannsen et al. | 29/611 |
| 4,034,207 | 7/1977 | Tamada et al. | 219/517 |
| 4,037,082 | 7/1977 | Tamada et al. | 219/541 |
| 4,051,550 | 9/1977 | Seno et al. | 361/482 |
| 4,099,216 | 7/1978 | Woberg | 361/96 |
| 4,162,395 | 7/1979 | Kobayashi et al. | 219/367 |
| 4,174,511 | 11/1979 | Knapp et al. | 337/107 |
| 4,177,446 | 12/1979 | Diaz | 338/212 |
| 4,177,785 | 12/1979 | Sundeen | 123/179 |
| 4,237,441 | 12/1980 | van Konynenburg et al. | 338/22 |
| 4,286,376 | 9/1981 | Smith-Johannsen et al. | 29/611 |
| 4,317,027 | 2/1982 | Middleman et al. | 219/553 |
| 4,329,726 | 5/1982 | Middleman et al. | 361/58 |
| 4,352,083 | 9/1982 | Middleman et al. | 338/23 |
| 4,388,607 | 6/1983 | Toy et al. | 338/22 |
| 4,400,614 | 8/1983 | Sopory | 219/528 |
| 4,413,174 | 11/1983 | Ting | 219/511 |
| 4,413,301 | 11/1983 | Middleman et al. | 361/106 |
| 4,426,339 | 1/1984 | Kamath et al. | 264/22 |
| 4,445,026 | 4/1984 | Walker | 219/553 |
| 4,467,310 | 8/1984 | Jakab | 338/22 R |
| 4,481,498 | 11/1984 | McTavish et al. | 338/20 |
| 4,514,620 | 4/1985 | Cheng et al. | 219/553 |
| 4,543,474 | 9/1985 | Horsma et al. | 219/553 |
| 4,689,475 | 8/1987 | Matthiesen | 219/553 |
| 4,724,417 | 2/1988 | Au et al. | 338/22 R |
| 4,743,321 | 5/1988 | Soni et al. | 156/85 |

FOREIGN PATENT DOCUMENTS

| | | |
|---|---|---|
| 031283 | 7/1981 | European Pat. Off. . |
| 038713 | 10/1981 | European Pat. Off. . |
| 038718 | 10/1981 | European Pat. Off. . |
| 098647 | 1/1984 | European Pat. Off. . |
| 2434006 | 2/1976 | Fed. Rep. of Germany . |
| 2644256 | 3/1978 | Fed. Rep. of Germany . |
| 2825442 | 12/1979 | Fed. Rep. of Germany . |
| 2946842 | 7/1981 | Fed. Rep. of Germany . |
| 2321751 | 4/1976 | France . |
| 2528253 | 12/1983 | France . |

*Primary Examiner*—Marvin M. Lateef

*Attorney, Agent, or Firm*—Marguerite E. Gerstner

[57] ABSTRACT

Circuit protection systems which comprise a PTC resistor and a second resistor, e.g. a thick film resistor, which is thermally and electrically connected to the PTC resistor have a break current $I_B$ and a hold current $I_H$ such that the ratio $I_B/I_H$ is at most 20. Suitable PTC resistors are conductive polymer devices which comprise a PTC element which has been radiation cross-linked under conditions such that the average dose rate is at most 3.0 Mrad/minute or during which no part of the PTC element which is in contact with the electrodes reaches a temperature greater than $(T_m-60)$°C., where $T_m$ is the melting point of the polymeric component of the conductive polymer.

20 Claims, 6 Drawing Sheets

ELECTRICAL DEVICE COMPRISING CONDUCTIVE POLYMERS

CROSS-REFERENCE TO RELATED APPLICATIONS

This application is a continuation-in-part application of International Application No. PCT/US88/03377 filed Sept. 30, 1988 (Fang et al), and is also a continuation-in-part application of copending, commonly assigned application Ser. No. 102,987 filed Sept. 30, 1987 (Fang et al). This application is also related to application Ser. Nos. 115,089 filed Oct. 30, 1987 (Fang et al) and 124,696 filed Nov. 24, 1987 (Fang et al), both now abandoned. The disclosures of each of these applications is incorporated herein by reference.

BACKGROUND OF THE INVENTION

1. Field the Invention

This invention relates to electrical devices, particularly circuit protection devices, comprising PTC conductive polymer compositions 2. Introduction to the Invention Conductive polymer compositions exhibiting PTC (positive temperature coefficient) behavior, and electrical devices comprising them, are well-known. Reference may be made, for example, to U.S. Pat. Nos. 3,243,753; 3,351,882; 3,861,029; 4,177,376; 4,237,441; 4,238,812; 4,255,698; 4,286,376; 4,315,237; 4,317,027; 4,329,726; 4,330,703; 4,352,083; 4,413,301; 4,426,633; 4,450,496; 4,475,138; 4,481,498; 4,534,889; 4,543,474; 4,562,313; 4,647,894; 4,647,896; 4,685,025; 4,654,511; 4,689,475; 4,724,417; 4,761,541; and 4,774,024; French Patent Application No. 7623707 (Moyer); European Patent Application No. 158,410; and commonly assigned, copending applications Ser. Nos. 141,989 (MP0715, Evans), now U.S. Pat. No. 5,049,850, published as European Application No. 38,713; 656,046 (MP0762, Jacobs et al), now abandoned in favor of four continuing applications, application Ser. Nos. 146,460 (now U.S. Pat. No. 4,845,838), 146,652 (now U.S. Pat. No. 4,951,384), 146,653 (now U.S. Pat. No. 4,951,382), and 146,654 (now U.S. Pat. No. 4,955,267), all filed Jan. 21, 1988, and published as European Application No. 63,440; 818,846, now abandoned, and 75,929 (MP1100, Barma et al) published as European Application No. 231,068; 83,093 (MP1090, Kleiner et al); now U.S. Pat. No. 4,861,966; 102,987 (MP1220, Fang et al) now U.S. Pat. No. 4,907,340; 103,077 (MP1222, Fang et al), now abandoned in favor of a continuation application Ser. No. 293,542, filed Jan. 3, 1989, now U.S. Pat. No. 4,924,074; 115,089 (MP0906, Fang et al) now abandoned; 124,696 (MP0906, Fang et al) now abandoned in favor of three continuation applications Ser. Nos. 455,715, 456,015, and 456,030, filed Dec. 22, 1989; 150,005 (MP0906, Fahey et al); now U.S. Pat. No. 4,780,598 and 219,416 (MP1266, Horsma et al), now U.S. Pat. No. 4,967,176.

Particularly useful devices comprising PTC conductive polymers are circuit protection devices. Such devices have a relatively low resistance under the normal operating conditions of the circuit, but are "tripped", i.e. converted into a high resistance state, when a fault condition, e.g. excessive current or temperature, occurs. When the device is tripped by excessive current, the current passing through the PTC element causes it to self-heat to an elevated temperature at which it is in a high resistance state. When the circuit protection device is "tripped", a thermal gradient is created. Where the thermal gradient flows in the same direction as the current flow, measures can be taken to assure that the peak temperature of the thermal gradient, i.e. the "hotline" or "hotzone" does not form near an electrode. Such preventative measures are described in U.S. Pat. Nos. 4,317,027 and 4,352,083, the disclosures of which are incorporated herein by reference.

Jakab U.S. Pat. No. 4,467,310, the disclosure of which is incorporated herein by reference, describes a battery feed resistor comprising a thick film resistor and a PTC resistor in the form of a disc. The thick film resistor and the PTC resistor are electrically connected in series and are mounted opposite each other on either side of the ceramic substrate carrying the thick film resistor, or on either side of another an insulating layer, with the objective of achieving close thermal coupling between the resistors. The purpose of this arrangement is to prevent the thick film resistor from posing a fire risk by becoming too hot when a fault causes power line voltage to be applied to the resistor. If such a fault occurs, the initial temperature rise of the thick film resistor heats the PTC resistor, which thus increases rapidly in resistance and reduces the current to a safe level before the thick film resistor becomes too hot. Thus the PTC resistor provides protection (both for the thick film resistor and for other components of the circuit) by reducing the current to a trickle current. In all of Jakab's devices the PTC resistor is composed of a ceramic material and is mounted so as to provide the closest possible thermal coupling between it and the thick film resistor.

Circuit protection devices which have improved physical properties and improved electrical performance are produced when the conductive polymer composition comprising the device is crosslinked. Such crosslinking can be accomplished through the use of chemical crosslinking agents or gamma or electron irradiation, or a combination of these. It is frequently true that ionizing irradiation generated by an electron beam results in the most rapid and cost-effective means of crosslinking.

SUMMARY OF THE INVENTION

We have now discovered that improved protection of circuits against excessive currents (and the voltages which produce such currents) can be obtained through the use of composite protection devices which comprise a PTC device (the terms "PTC device" and "PTC resistor" used synonomously) and a second electrical component which, under at least some of the fault conditions against which protection is needed, modifies the response of the PTC device to the fault conditions in a desired way. For example, the second component may be a resistor which, under the fault conditions, generates heat which is transferred to the PTC device and thus reduces the "trip time" of the device, i.e. the time taken to convert the PTC device into a high resistance, high temperature state such that the circuit current is reduced to a safe level. The second component may function substantially only to reduce the trip time, but it is preferably part of the circuit protection system. The reduction of the current by the PTC device may serve to protect the second component and/or to protect other components of the circuit.

We have also now discovered, in accordance with the present invention, that in circuit protection arrangements which comprise a PTC resistor and, connected in series with the PTC resistor, a second resistor which can fail in an open circuit state, there can be two useful protective mechanisms. The first mechanism operates when a relatively low overvoltage is dropped over the protection arrangement and protection is provided by the PTC resistor increasing in resistance and reducing the current to a safe level. The second mechanism operates when a relatively high overvoltage is dropped over the protection arrangement, and protection is provided by the second resistor failing in the open circuit state. We have further discovered, in accordance with the present invention, that the extent of the thermal coupling between the PTC resistor and the second resistor can have a profound influence on which of these protective mechanisms will be caused to operate by a particular voltage. The better the thermal coupling between the resistors, the higher the voltage needed to cause operation of the second mechanism in preference to the first mechanism.

The PTC resistor can be of any type, e.g. it can be composed of a ceramic or a conductive polymer. However, the invention is of particular value for PTC materials, especially conductive polymers, which, if subjected to excessive electrical stress (i.e. greater than that involved in the normally anticipated fault condition) can degrade in a hazardous manner; this can be avoided, in accordance with the present invention, by associating the PTC resistor with a second resistor which, if subjected to the same excessive electrical stress (or to an electrical stress which is related in some predetermined way to the excessive electrical stress on the PTC resistor), will fail (in the open circuit condition) in a time which is sufficiently short to ensure that the PTC material does not undergo hazardous degradation. Thus in such an arrangement, there is, under the influence of the excessive electrical stress, a reversal of the roles previously played in protective arrangements comprising a PTC resistor and a second resistor; the second resistor protects the PTC resistor, rather than (as before) the PTC resistor protecting the second resistor.

The second resistor can be of any kind, but is preferably a ZTC resistor, and its ability to fail in an open circuit state can be achieved in any way. The invention is of particular value for thick film or other resistors which are supported by ceramic substrates. Such thick film resistors can fail, under excessive electrical stress, as a result of differential expansion of the resistor and the substrate, and/or of different parts of the substrate, and/or of different parts of the resistor, which leads to disruption of the resistor and/or of one or more of the connections to the resistor which lie in or on the substrate. Thus the conditions which will cause such failure depend importantly on the dimensions and composition of the substrate; for example the substrate can be formed with a plane of weakness (e.g. a necked portion or a groove scribed with a laser or a diamond) which will induce cracking, bearing in mind the thermal gradients which will exist in use. Such thermal gradients can be influenced by differential heat sinking part of the substrate, e.g. by means of the electrical leads and/or by means of metal plates or strips (which may extend from the substrate) which do not carry current, and/or by making use of a resistor of irregular shape, e.g. a wedge shape.

The PTC resistor and the second resistor are preferably part of a single composite device.

There may be more than one PTC resistor, such PTC resistors being the same or different and being connected in series or parallel with each other, and/or there may be more than one second resistor, such second resistors being the same or different and being connected in series or in parallel.

Accordingly, in its first aspect, this invention provides a circuit protection system which comprises a PTC resistor and a second resistor which is electrically connected in series with the PTC resistor and is in thermal contact with the PTC resistor, the system having a break current $I_B$ (measured as hereinafter described) and a hold current $I_H$ (measured as hereinafter described), and the ratio $I_B/I_H$ being at most 20, preferably at most 15, particularly at most 10.

Composite devices in which the PTC resistor is connected to a second component which is not a resistor are also provided by the invention. Thus, in a second aspect this invention provides an electrical apparatus which comprises (1) at least one laminar substrate;
(2) at least one first electrical component which (i) is physically adjacent to at least one of said substrates, (ii) has a resistance $R_1$, and (iii) comprises
  (a) a laminar PTC element composed of a conductive polymer which exhibits PTC behavior with a switching temperature $T_s$, and
  (b) at least two laminar electrodes which can be connected to a source of electrical power so that current passes between the electrodes through the PTC element;
(3) at least one second electrical component which
  (a) is physically adjacent to at least one of said substrates,
  (b) is in good thermal contact with at least one first component,
  (c) is electrically connected with at least one first component,
  (d) has a resistance $R_2$ which changes as a function of voltage; and
(4) an electrical connector which is electrically connected to at least one first component and which is in thermal contact with at least one second component.

The use of laminar PTC devices in composite devices is advantageous in achieving adequate contact to and rapid heat transfer between the PTC device and the second component, and provides optimum use of available space particularly when the composite device is designed for use on a printed circuit board. For most applications, it is desirable that the PTC device be irradiated, and for many applications where the applied voltage is 60 VAC or higher, high irradiation doses, e.g. greater than 50 Mrad, are useful. We have discovered that one difficulty with electron beam irradiation is the rapid temperature rise in the conductive polymer as a result of irradiation to these high doses. An additional problem is that under these conditions, gases are generated during the crosslinking process more rapidly than they can be dissipated. As a result, devices designed for use under high voltage conditions have been made with parallel columnar electrodes embedded in the conductive polymer matrix rather than with laminar metal foil or mesh electrodes attached to the surface of the laminar conductive polymer element in order to avoid the delamination of the metal foil electrodes as a result of the gases generated. For instance, U.S. Ser. No. 656,046 published as European Patent Application No. 63,440, teaches that is is necessary to irradiate a laminar conductive polymer element before the laminar electrodes are attached to form a device. For devices comprising embedded columnar electrodes, rapid heating and generation of gases during irradiation may result in the formation of voids at the polymer/electrode interface, producing contact resistance and sites for electrical failure during operation at high voltage.

In order to efficiently and cheaply manufacture laminar devices, it is desirable that laminar metal foil electrodes be attached prior to irradiation and that devices with columnar electrodes do not suffer from void-formation at the polymer/electrode interface as a result of rapid gas generation. It is also desirable that a laminar device be capable of withstanding relatively high voltages and currents without delamination of the laminar electrodes. We have found that electrical devices with improved performance can be produced if the conductive polymer element is maintained at a low temperature during the irradiation process.

Accordingly, in its third aspect, this invention provides a process for the preparation of an electrical device which comprises (1) a PTC element composed of a crosslinked conductive polymer composition which exhibits PTC behavior and which comprises a polymeric component and, dispersed in the polymeric component, a particulate conductive filler; and (2) two electrodes which are electrically connected to the PTC element and which are connectable to a source of electrical power to cause current to pass through the PTC element, which process comprises subjecting the PTC element to radiation crosslinking in which said crosslinking is achieved by use of an electron beam and in which one of the following conditions is present (a) the average dose rate is at most 3.0 Mrad/minute; and (b) the radiation dose absorbed by each current-carrying part of the PTC element is at least 50 Mrad and, during the crosslinking process, no part of the PTC element which is in contact with the electrodes reaches a temperature greater than $(T_m-60)°$ C., where $T_m$ is the temperature measured at the peak of the endothermic curve generated by a differential scanning calorimeter for the lowest melting polymer in the polymer component.

The invention further includes electrical circuits which comprise a source of electrical power, a load and a circuit protection apparatus or device as defined above. In such circuits, the first and second electrical components can be connected in series both under the normal operating conditions of the circuit and under the fault conditions (e.g. when the second component is a surge resistor in a telephone circuit), or the second component can be one through which no current passes under normal operating conditions but is placed in series with the first component under the fault conditions (e.g. when the second component is a VDR which is connected to ground to provide a clampdown in a telephone circuit).

BRIEF DESCRIPTION OF THE DRAWING

The invention is illustrated in the accompanying drawing, in which.

DETAILED DESCRIPTION OF THE INVENTION

Figure 1:
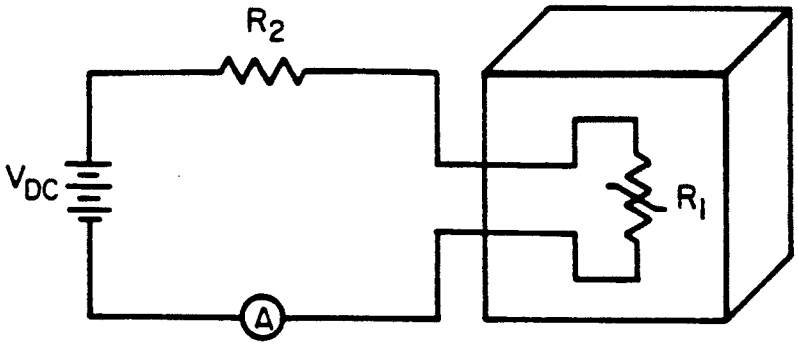
FIGS. 1 and 2 are circuit diagrams for determining $I_H$ and $I_B$, respectively.

The circuit protection devices of this invention exhibit PTC behavior. The term "PTC" is used in this specification to denote a device (e.g. a PTC resistor) or composition which has an $R_{14}$ value of at least 2.5 or an $R_{100}$ value of at least 10, and preferably both, and particularly one which has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. "ZTC behavior" is used to denote a device or composition which increases in resistivity by less than 6 times, preferably less than 2 times in any 30° C. temperature range within the operating range of the heater.

The invention described herein concerns electrical devices comprising a conductive polymer element and processes for preparing such devices. The conductive polymer element is composed of a polymeric component and, dispersed in the polymeric component, a particulate conductive filler. The polymeric component is preferably a crystalline organic polymer or blend comprising at least one crystalline organic polymer, such term being used to include siloxanes. The polymeric component has a melting temperature which is defined as the temperature at the peak of the endothermic curve generated by a differential scanning calorimeter. If the polymeric component is a blend of polymers, the melting temperature is defined as the melting temperature of the lowest melting polymeric component. The conductive filler may be graphite, carbon black, metal, metal oxide, a particulate conductive polymer which itself comprises an organic polymer and a particulate conductive filler, or a combination of these. The conductive polymer element may also comprise antioxidants, inert fillers, prorads, stabilizers, dispersing agents, or other components. Dispersion of the conductive filler and other components may be conducted by dry-blending, melt-processing or sintering. The resistivity of the conductive polymer is measured at 23° C. (i.e. room temperature).

The conductive polymer element exhibits PTC behavior with a switching temperature, $T_s$, defined as the temperature at the intersection of the lines drawn tangent to the relatively flat portion of the log resistivity vs. temperature curve below the melting point and the steep portion of the curve. Suitable compositions and PTC devices comprising the compositions are disclosed in U.S. Pat. Nos. 4,237,411; 4,238,812; 4,255,698; 4,315,237; 4,317,027; 4,329,726; 4,352,083; 4,413,301; 4,450,496; 4,475,138; 4,481,498; 4,534,889; 4,562,313; 4,647,894; 4,647,896; 4,685,025; 4,724,417; 4,774,024; and in copending commonly assigned U.S. application Ser. No. 141,989 (MP0715), now U.S. Pat. No. 5,049,850, the disclosures of which are incorporated by reference herein. If the PTC element comprises more than one layer, and one or more of the layers is made of a polymeric composition that does not exhibit PTC behavior, the composite layers of the element must exhibit PTC behavior. The conductive polymer should have a resistivity which does not decrease in the temperature range $T_s$ to $(T_s+20)°$ C., preferably $T_s$ to $(T_s+40)°$ C., particularly $T_s$ to $(T_s+75)°$ C.

The two electrodes attached to the PTC element are connectable to a source of electrical power to cause current to pass through the PTC element. The electrodes may be parallel columnar wires embedded within the conductive polymer or laminar electrodes comprising solid or perforated metal or metal mesh which are attached to the surface of the PTC element. Particularly preferred are metal foil electrodes of nickel or copper which comprise an electrodeposited surface layer which has a microrough surface.

The electrical device may be crosslinked by the use of a chemical crosslinking agent or a source of ionizing radiation, such as a cobalt source or an electron beam. Electron beams are particularly preferred for efficiency, speed, and cost of irradiation. The devices may be irradiated to any level, although for devices intended for use in high voltage applications, doses of 50 to 100 Mrad or more (e.g. to 150 Mrad) are preferred. The irradiation may be conducted in one step or in more than one step; each irradiation segment may be separated by a heat-treatment step in which the PTC element is heated to a temperature above the melting point of the polymeric component and is then cooled to recrystallize the polymeric component. The crosslinking process may be conducted with or without the electrodes attached to the PTC element. The radiation dose is defined as the minimum amount of radiation dose absorbed by each current-carrying part of the PTC element. In the case of laminar electrical devices in which the current flows in a direction normal to the plane of the laminar electrode (i.e. through the thickness of the PTC element), the entire PTC element must be irradiated to the minimum dose. For devices with embedded columnar electrodes, the center of the PTC element, between and parallel to the electrodes, must be irradiated to the minimum dose.

It is preferred that during the irradiation step, the temperature of no part of the PTC element which is in contact with the electrodes reaches a temperature greater than $(T_m-60)°$ C., particularly $(T_m-80)°$ C. In the case of devices composed of high density polyethylene which has a $T_m$ of about 130° C., it is preferred that the temperature remain less than 60° C., particularly less than 50° C., especially less than 40° C. In the case of an electron beam, this may be accomplished by cooling the devices through the use of fans or gas, or positioning the devices next to objects with large heat-sinking capabilities. Alternatively, maintaining a low temperature may be achieved through the use of a low electron beam current in which the average dose rate is at most 3.0 Mrad/minute. This value can be calculated based on the intensity of the electron beam and the pass rate of the devices through the beam path by taking the value at half-height of the bell curve of instantaneous dose rate plotted as a function of position of the devices in the beam path. It has been observed that if the device remains cool during the irradiation process the rate of gas generation (i.e. hydrogen from the crosslinking step) is balanced by the rate of diffusion of the gas from the device and few, if any, bubbles are observed at the interface of the PTC element and the electrodes. The result is that, in the case of laminar devices, the laminar electrodes do not delaminate, and with embedded columnar electrodes, the number and frequency of bubbles or voids at the polymer/electrode interface is limited. This results in improved electrical performance during application of electrical current.

Laminar electrical devices of the invention may comprise PTC elements which comprise three or more layers of conductive polymer. The layers may have the same or a different polymeric component or the same or a different conductive filler. Particularly preferred are devices with first, second and third layers arranged so that all current paths between the electrodes pass sequentially through the first, second and third layers. It is desirable that the second layer, which is sandwiched between the first and third layers, is the site of the hot-line which is formed when the device is exposed to an electrical current. This can be achieved by the use of a second layer which has a room temperature resistivity higher than that of both the first and the third layers. During operation, through $I^2R$ heating, heat will be generated at the site of the highest resistance; this process will be enhanced by the limited thermal dissipation of the center region (second layer) of the device with respect to the top or bottom regions (first or third layers). If the hot line is controlled at the center of the device, it will not form at the electrodes, eliminating one failure mechanism common to laminar devices.

The resistivity of the three layers can be varied in several ways. The polymeric component of the layers may be the same, but the volume loading of conductive filler can be different for the second layer. In most cases, a higher resistivity is achieved by the use of either a lower volume loading of conductive filler or the same loading of a conductive filler with a lower electrical conductivity than the filler of the first layer. In some cases, a higher resistivity can be achieved by the use of the same volume loading of conductive filler but a lower loading of a non-conductive filler. It has been found that when the conductive filler is carbon black, useful compositions can be achieved when the polymeric component is the same for the layers, but the carbon black loading of the second layer is at least 2, preferably at least 3, especially at least 4 volume percent lower than that of the first or third layers. The resistivity of the second layer is preferably at least 20 percent, particularly at least two times, especially at least five times higher than the resistivity of the first and third layers. A PTC element made from the three layers may have a second layer with a resistivity of less than 50 ohm-cm or a resistance of less than 100 ohms. In another embodiment, the resistivity of the first layer and the third layer is less than 0.1 times the resistivity of the second layer.

Layered devices have been disclosed in the art for constructions of PTC and ZTC materials which differ in resistivity by at least one order of magnitude. It has been found that useful laminar devices can be made where all three layers exhibit PTC behavior if the switching temperature, $T_s$, of each of the layers is within 15° C. of the switching temperature of the second layer. It is preferred that $T_s$ be the same for all three layers; this can be achieved by the use of the same polymeric component in the conductive polymer composition for each layer.

Useful layered laminar devices with hotline control can also be made when the second layer comprises less than one-third, preferably less than one-fourth, particularly less than one-fifth of the total thickness of the first, second and third layers. Preferred devices have a total thickness of at least 0.060 inch, particularly at least 0.100 inch. They have a resistance of less than 100 ohms. Such devices are useful for circuit protection applications where the applied voltage is 120 V or greater, particularly when they have been exposed to irradiation to a level of more than 50 Mrad. Particularly preferred for such applications are devices in which at least the second layer, and preferably the first and third layers as well comprise a composition which contains an inorganic filler. Particularly preferred are those inorganic fillers which serve as arc controlling agents and which, when heated in the absence of air, decompose to give $H_2O$, $CO_2$, or $N_2$. Suitable materials, including alumina trihydrate and magnesium hydroxide are disclosed in U.S. Pat. No. 4,774,024 and application Ser. No. 141,989, now U.S. Pat. No. 5,049,850, the disclosures of which are incorporated herein by reference.

The electrical apparatus aspects of this invention comprise at least one first component, which is often a laminar PTC resistor, at least one second component, a laminar substrate, and an electrical lead. The second component is commonly a resistor whose resistance is comparatively independent of voltage, although in one aspect of the invention it is preferred that the second component have a resistance which changes as a function of voltage. Such components include a voltage-dependent resistor (VDR) such as a varistor, a transistor or another electronic component. Alternatively, the second component can, for example, be a resistor which is a thick film resistor, a thin film resistor, a metallic film resistor, a carbon resistor, a metal wire, or a conductive polymer resistor formed by, for example, melt-shaping (including melt-extrusion, transfer molding and injection molding), solution-shaping (including printing and casting), sintering or any other suitable technique. The resistance of resistors produced by some of these techniques can be changed by laser-trimming techniques. The resistance of the resistor at 23° C. is preferably at least 2 times, particularly at least 5 times, especially at least 10 times or even higher, e.g. at least 20 times, the resistance at 23° C. of the PTC element. The resistance of the resistor preferably does not increase substantially with temperature. For high voltage applications, e.g. where the voltage is greater than about 200V, the resistance of the resistor is generally at least 20 times, preferably at least 40 times, particularly at least 60 times, or even higher, e.g. at least 100 times, the resistance at 23° C. of the PTC element. The preferred total resistance at 23° C. of the first and second components together will depend on the end use, and may be for example 3 to 2000 ohms, e.g. 5 to 1500 ohms, but is usually 5 to 200 ohms, with the resistance of the PTC element being for example 1 to 100 ohms, usually 1 to 5 ohms.

There can be two or more second electrical components, which can be the same or different. Preferred is an apparatus which acts as a dual hybrid integrated protector in which one second electrical component comprises a thick film resistor and another second electrical component comprises a voltage limiting device. If there are two or more second electrical components, the combined resistance of the second components which are connected in series with a single PTC element is the resistance used when determining the desired ratio of the resistor (or other second component) resistance to that of the PTC element. If the electrical apparatus comprises multiple PTC elements and multiple second components, the resistance of the apparatus is defined as that of each individual PTC element and its associated second components (i.e. those second components which are connected in series with the PTC element). For such apparatus, the resistance of each "unit" comprising a PTC element and second components are preferably the same. Electrical apparatus comprising multiple first and/or second components and substrates is advantageous in providing compact apparatus. Such apparatus requires less space on a circuit board, requires a smaller encapsulation or insulation enclosure, and may respond more rapidly to electrical fault conditions due to better thermal contact between the components. Additionally, the use of multiple components provides the potential for multiple functions.

Electrical connection is made between the components by means of wires, ink connector pads, clips, or other appropriate means. When the components are positioned on opposite surfaces of the substrate metallized vias drilled through the substrate may serve as connections.

Preferred substrates are those which are electrically insulating but have some thermal conductivity, e.g. alumina or berylia. Such substrates may be readily mounted onto a printed circuit board by means of leads which may comprise wires, screen-printed ink, sputtered traces or other suitable materials. In order to minimize the size of the apparatus on the circuit board, it is preferred that the alumina (or other) substrate have maximum dimensions of 0.100 inch in thickness, 1.5 inch in width, and 0.400 inch in height. This generally allows the apparatus to be lower than the 12 mm (0.47 inch) maximum height constraint of many circuit boards.

The relative position of the components is important in determining the electrical response of the apparatus. In some embodiments, the first and second electrical components are preferably arranged so that the thermal gradient induced in the PTC element is at right angles to the direction of current flow in the PTC element. This is important because the heat flow can otherwise encourage formation of the hot zone adjacent one of the electrodes, which is undesirable. When laminar PTC devices are used they provide better thermal contact to a laminar substrate and can be smaller than PTC elements of other configurations of comparable resistance. Such laminar PTC devices also allow design flexibility. The PTC device may be attached directly to the surface of the laminar element or the second component, or it may be attached to the opposite side of the substrate For circuit protection systems, both the hold current (i.e. the maximum current that can flow through the system without causing the PTC device to pass into its high resistance "tripped" state) and the break current (i.e. the minimum current that causes the system to reach an open circuit condition), may be influenced by the rate of heat dissipated into and out of the PTC device. Thermal transfer can be affected by the distance between the PTC device and the second component. For some applications it is preferred that the PTC device have a position which is "offset" that of the second component. This is particularly important when the second component comprises a thick film resister which may be subject to cracking if the thermal gradient is too severe. Thus for many systems it is preferred that at least a part of the PTC device does not overlap the second component when the system is viewed at right angles to the plane of the second component. When the planes of the PTC element and the thick film resistor are substantially parallel to one another, the proportion of the PTC element which overlaps the thick film resistor (viewed at right angles to the plane of the thick film resistor) is at most 75%, preferably at most 50%, especially at most 25%, most especially 0%.

In some cases the apparatus of the invention may be used to protect the thick film resistor or other second electrical component from damage caused by exposure to high temperatures. Under these conditions, the PTC device is selected such that it is converted to a high resistance state at a temperature below that which causes damage to the resistor.

The hold current, $I_H$, and the break current, $I_B$, can be determined by testing the electrical apparatus comprising the PTC device and the second component in two test circuits. In the first circuit, shown in FIG. 1, the composite device $R_1$ is connected in series with a variable resistor $R_2$, a DC power supply VDC, and a ampmeter A. The value of $R_2$ is chosen (and remains fixed during the test) so that when the voltage is varied from 0 volts to 70 volts, the current measured with the ammeter from 0 to 100 mA. The composite device is placed into a chamber with a controlled air flow and temperature and allowed to stabilize to 23° C. The voltage is then increased and the current in the circuit is monitored. The voltage at which the current drops to zero (or a value approximating 10% of the maximum current observed) is recorded as VH. The hold current is then calculated from the following equation:

$$I_H = V_H/(R_1+R_2).$$

Figure 2:
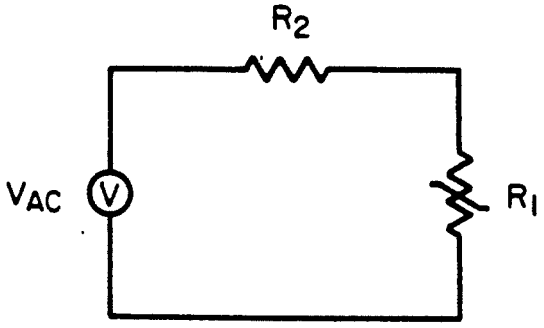

The break current is determined by using the circuit shown in FIG. 2. The composite device with a resistance $R_1$ is connected in series with a variable resistor $R_3$ and an AC power supply VAC. The resistance of the device at 23° C. is measured to give $R_0$ and the variable resistance $R_3$ is adjusted to 1000 ohms. Power at 110 VAC is applied for a period of 1 second. The device is then allowed to cool at 23° C. for one hour and the resistance is then measured. If the composite device has successfully tripped into a high resistance state during the test, the resistance will equal $0.5R_0$ to $1.5R_0$. Under these conditions, the test is repeated but $R_3$ is decreased. The test is repeated until $R_3$ is sufficiently small so that the device resistance under the cool down period is high, i.e. the device is open circuit. The break current can then be calculated from the following equation:

$$I_B = V/(R_1f+R_3f)$$

where $R_1f$ is the resistance of the device measured prior to the final "breaking" cycle and $R_3f$ is the resistance of the variable resistor on the final "breaking" cycle.

When tested under these two conditions, devices of the invention comprising a PTC resistor and a second resister which is electrically connected in series with the PTC resistor and thermally in contact with the PTC resistor will have a break current $I_B$ and a hold current $I_H$ so that the ratio $I_B/I_H$ is at most 20, preferably at most 15, particularly at most 10. It is also preferred that the ratio $I_B/I_H$ be at least 3, preferably at least 5, particularly at least 7.

Figure 3:
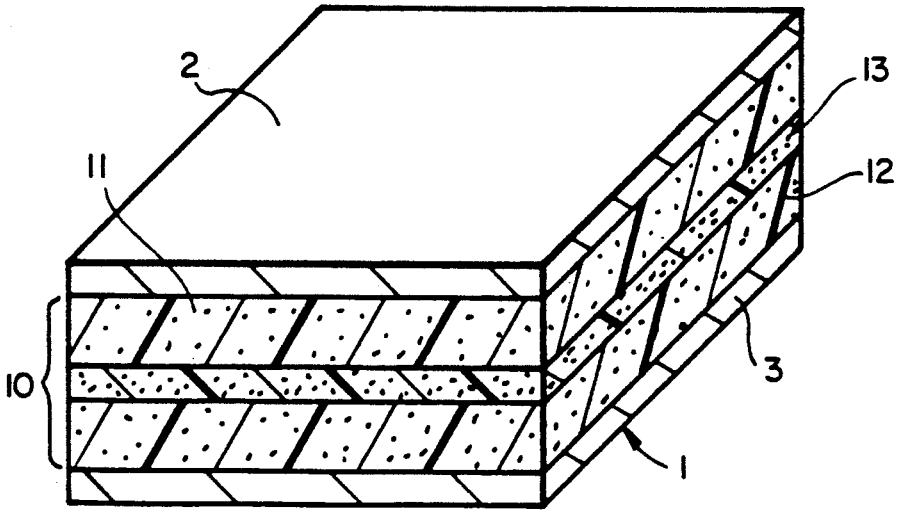
FIG. 3 is a plan view of an electrical device of the invention.

FIG. 3 shows a circuit protection device (i.e. a PTC device) 1 which has two laminar metal electrodes 2,3 attached to a PTC element 10. The PTC element is composed of a first conductive polymer layer 11 and a third conductive polymer layer 12 sandwiching a second conductive polymer layer 13.

FIGS. 4 to 12 illustrate versions of the invention wherein the circuit protection device 1 is adjacent to a rigid, laminar insulating substrate. In each version silver or other conductive paste is deposited by screen-printing or other means in a pattern suitable for making connection between the PTC device 1 and a second electrical component.

Figure 4:
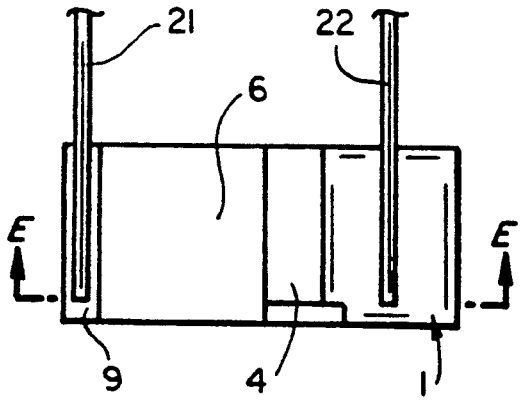
FIG. 4 is a plan view and FIG. 5 is a cross-sectional view on line A—A of FIG. 4 of an apparatus of the invention.
Figure 5:
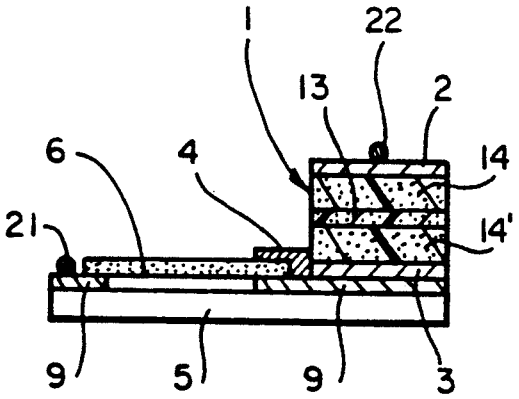

FIG. 4 shows an apparatus wherein the PTC device 1 and the second electrical component, a thick film resistor 6, are arranged on the same side of the substrate 5. As shown in FIG. 5, a cross-sectional view taken along line A—A of FIG. 4, the PTC device 1 is laminar and comprises a PTC element as shown in FIG. 3. A lead wire 4 connects the bottom electrode 3 of the PTC device to the thick film resistor 6. Leads 21,22 for connecting the apparatus into a circuit are attached to one edge of the silver conductor pad 9 under the thick film resistor and to the top electrode 2 of the PTC device.

Figure 6:
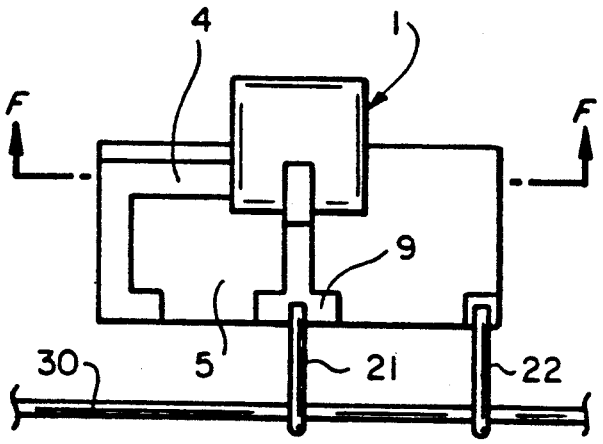
FIG. 6 is a plan view and FIG. 7 is a cross-sectional view on line B—B of FIG. 6 of another apparatus of the invention.
Figure 7:
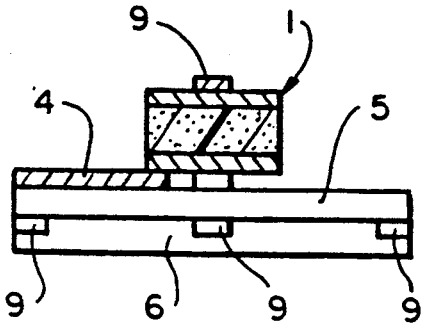

FIG. 6 and FIG. 7 (a cross-sectional view taken along line B—B of FIG. 4) show an alternative version of the invention in which the thick film resistor 6 and the PTC device 1 are on opposite sides of the alumina substrate 5. Also shown are leads 21,22 which are suitable for insertion into a printed circuit board 30.

Figure 8:
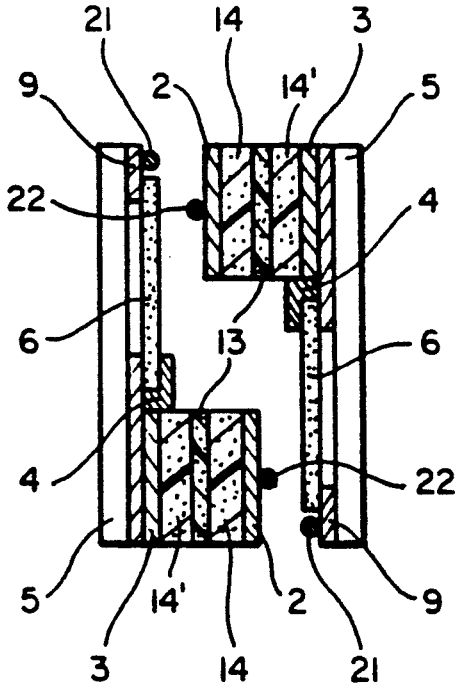
FIG. 8 is a cross-section of a further apparatus of the invention.

FIG. 8 shows in cross-section an apparatus comprising two devices of the type shown in FIG. 6 which are packaged to minimize the space required on the circuit board.

Figure 9:
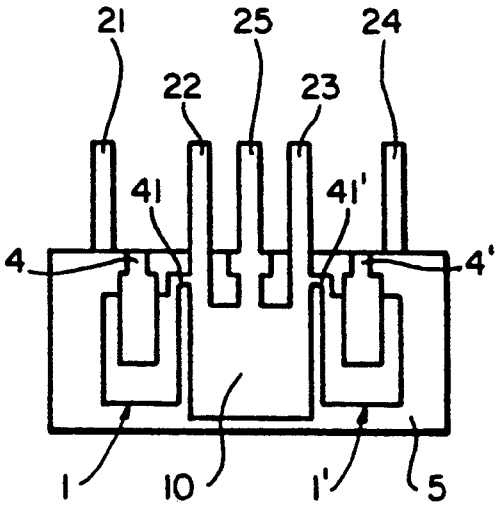
FIGS. 9 and 10 are plan views of two different sides of an addition apparatus of the invention.
Figure 10:
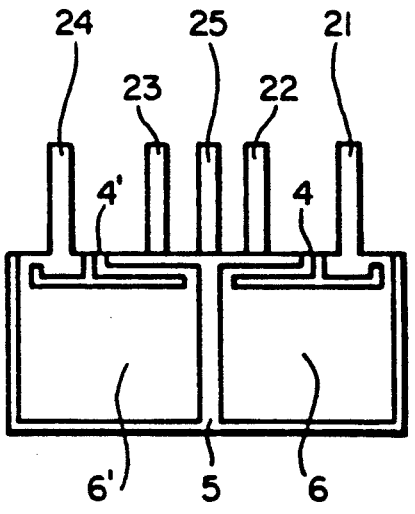

FIGS. 9 and 10 show the opposite sides of the alumina substrate 5 used in a version of the invention comprising three electrical components. Two thick film resistors 6,6' are screen-printed adjacent to one another on one side of the substrate. On the other side of the substrate, two PTC devices 1,1' are positioned adjacent to a voltage limiting device 30. Electrical connections are made independently between PTC device 1 and thick film resistor 6 and between PTC device 1' and thick film resistor 6' by means of solder paste or solder leads 4,4'. Connection is made between PTC device 1 and voltage limiting device 30 by means of lead 41. Similar connection to PTC element 1' is made by means of lead 41'. Leads 21,22 and 23,24 are used to connect the device to the circuit. Ground lead 25 is attached to the voltage limiting device 30.

Figure 11:
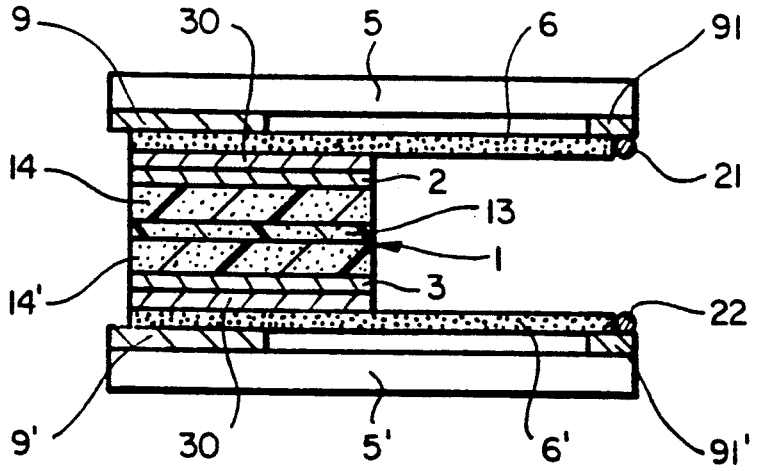
FIGS. 11 and 12 are cross-sections of an alternative apparatus of the invention.

FIG. 11 shows an apparatus in which the PTC device 1 is sandwiched between two ruthenium oxide resistors 6,6', each of which is printed onto a separate alumina substrate 5,5'. The PTC device is attached to the substrate by means of a solder layer 40 between the electrodeposited foil electrodes 2,3 and the resistors 6,6'. Wire leads 21,22 are attached to conductor pads 91,91' and allow the current to flow from the lead through a first resistor 6, through the PTC device 1, and then through a second resistor 6'.

Figure 12:
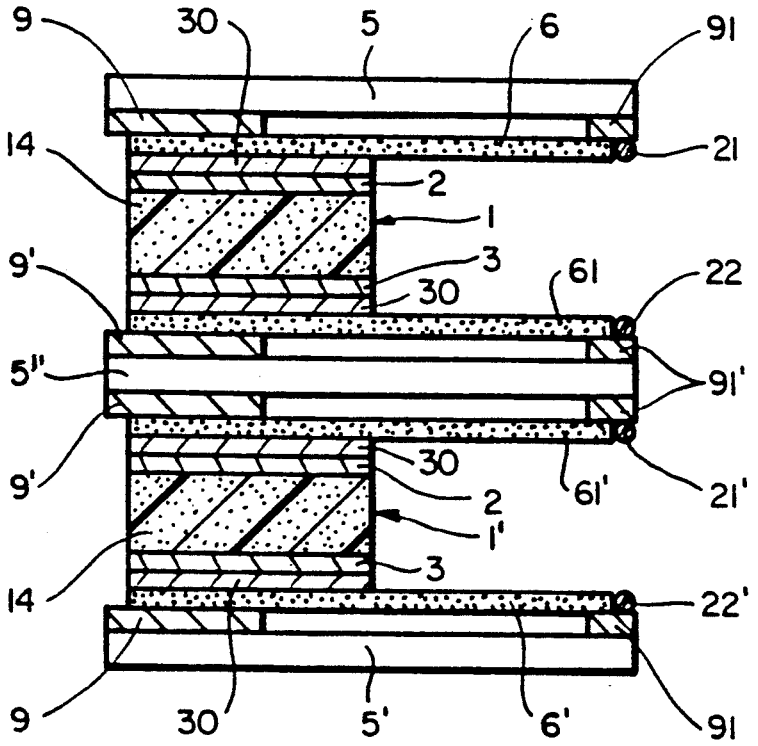
Figure 13:
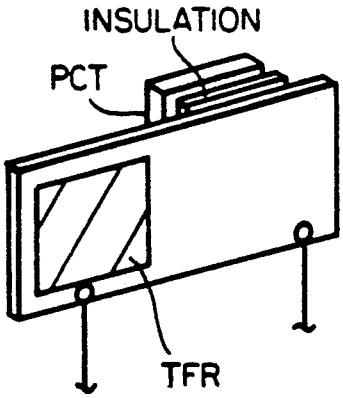
FIGS. 13 to 18 are possible designs for composite devices of the invention.
Figure 14:
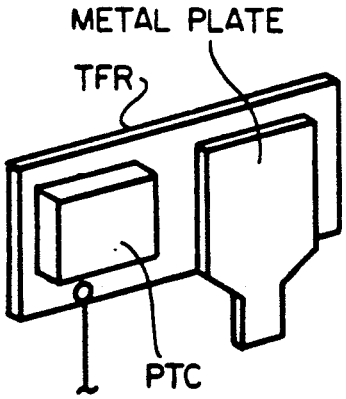
Figure 15:
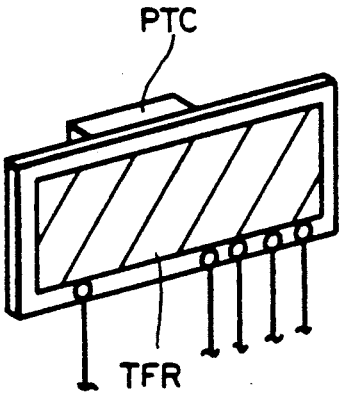
Figure 16:
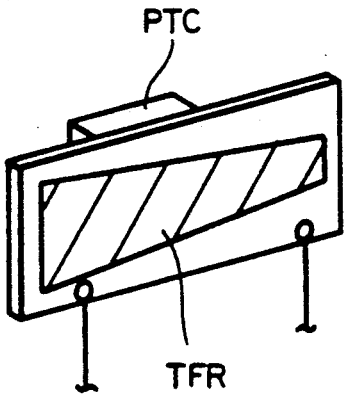

FIG. 12 shows an apparatus containing multiple components. Two PTC devices 1,1' are soldered by means of layer 40 onto opposite sides of a laminar substrate 5'', each side of which has been printed with resistors 61,61'. Two additional substrates 5,5' are attached to the remaining side of each PTC element. Wire leads 21,22,21',22' are attached to conductor pads 91,91' to provide two separate units which may be individually powered.

Figure 17:
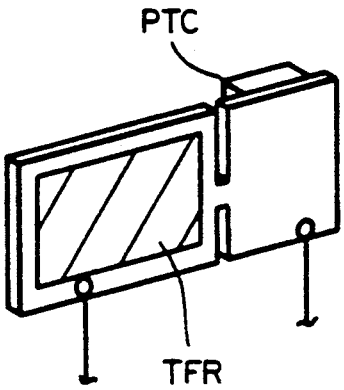
Figure 18:
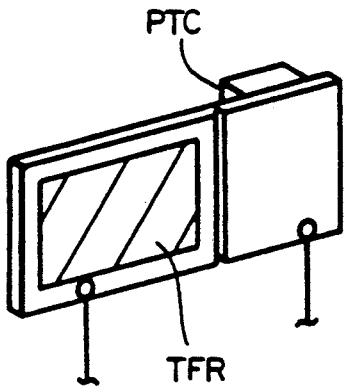

FIGS. 13 to 18 show possible designs for composite devices which contain PTC resistors which are offset from the second resistor and/or means for influencing the relationship between $I_B$ and $I_H$, e.g. the use of additional leads (FIG. 15), heat-sinking clips (FIG. 14), non-uniform (e.g. tapered) resistor (FIG. 16), cut or scribed substrates (FIGS. 17 and 18, respectively).

Figure 19:
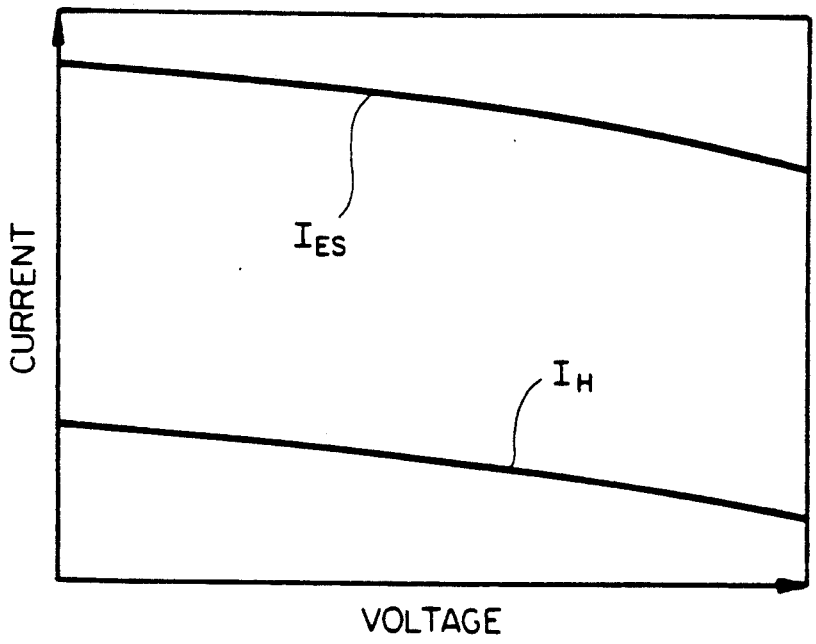
FIG. 19 is a graph of the current vs. voltage characteristics for a PTC circuit protection device.

FIG. 19 shows schematically a graph of current as a function of voltage for a PTC circuit protection device which is not electrically or thermally connected to a second component such as a resistor. The $I_H$ (the hold current) curve represents the region below which the device is not tripped. The upper curve, $I_{ES}$ (the electrical stress current), represents the current level resulting from excessive electrical stress. At currents above this $I_{ES}$ curve, the device will fail in a hazardous manner. In the region between the $I_H$ curve and the $I_{ES}$ curve, the device will trip safely into a high resistance state.

Figure 20:
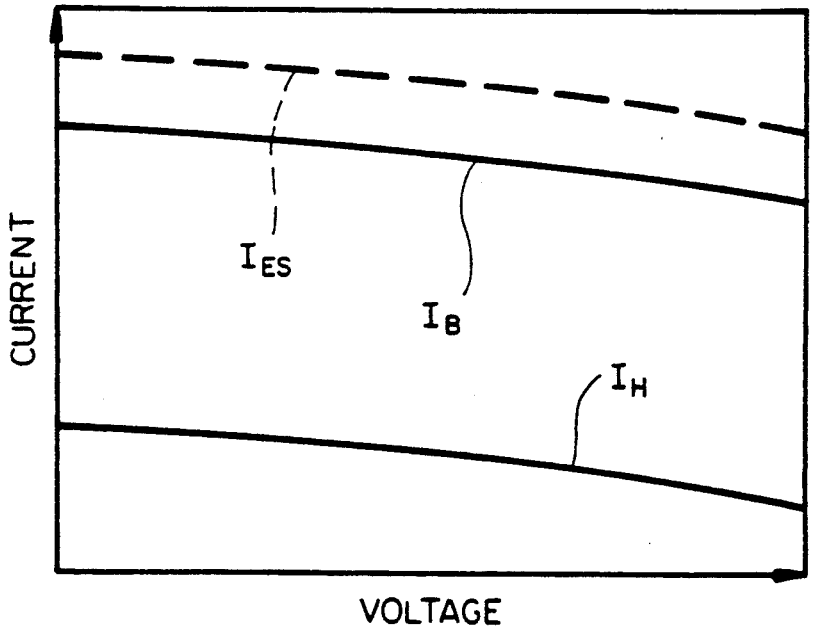
FIG. 20 is a graph of the current vs. voltage characteristics for a circuit protection system which comprises a PTC resistor and a second resistor.

FIG. 20 shows schematically a graph of current as a function of voltage for a circuit protection system which comprises a PTC resistor and a second resistor. Such systems, in which the second resistor may be a thick film resistor, are shown in FIGS. 13 to 18. The curve for $I_H$ is the same as that for the device shown in FIG. 19. However, the $I_{ES}$ curve, shown here as a dashed line, is well above the $I_B$ (the break current) curve, i.e. the minimum current that causes the system to reach an open circuit condition. Under systems of this type, if the current is above $I_B$, the resistor will fail, e.g. crack, in a time which is short enough to prevent the PTC resistor from failing in an unsafe manner. For circuit protection systems of the invention, the ration of $I_B/I_H$ for a given voltage is at most 20, preferably at most 15, particularly at most 10.

The invention is illustrated by the following examples.

EXAMPLE 1

Conductive compounds A and B as listed in Table I were prepared using a Banbury mixer, pelletized, and extruded into sheet. A laminated plaque with a thickness of 0.120 inch (0.304 cm) was made by stacking two layers of Compound A sheet, each with a thickness of 0.025 inch (0.064 cm), on either side of a single layer of 0.020 inch- (0.051 cm)-thick Compound B sheet. Electrodeposited nickel foil electrodes with a thickness of 0.0014 inch (0.0036 cm) available from Fukuda were attached to each side of the plaque. PTC devices were prepared by cutting 0.3 by 0.3 inch (0.76 by 0.76 cm) chips from the plaque. These were processed by heating at 150° C. for one hour, irradiating to a dose of 25 Mrad using a 1.5 MeV electron beam at 5 mA, heating a second time, irradiating to 50 Mrads using a 1.5 MeV electron beam at 5 mA, and heating a third time. Leads were attached to the electrodes by soldering. The electrical performance of the devices was determined by testing in two circuits. In the first test, the devices were powered at 260 VAC/10 A for 5 seconds; in the second test, the devices were powered at 600 VAC/1 A for 5 seconds. The number of devices surviving the test without flaming, sparking, or delamination of electrodes was determined after each cycle. The results are reported in Table II.

EXAMPLE 2

Compound E was prepared by mixing 40% by volume of Compound C with 60% by volume of Compound D; the blend was then extruded into sheet with a thickness of 0.010 inch (0.025 cm). Five layers of Compound E sheet were laminated on either side of one layer of Compound B sheet to produce a plaque with a thickness of 0.130 inch (0.330 cm). After attaching nickel electrodes, devices were cut, processed, and tested as described in Example 1. The results are shown in Table II. It is apparent that the devices which comprise inorganic filler in all three layers performed better than those with filler in only the center layer.

EXAMPLE 3

Compounds F and G were prepared and extruded into sheet with a thickness of 0.014 inch (0.036 cm) and 0.024 inch (0.061 cm), respectively. A plaque with a thickness of 0.082 inch (0.208 cm) was made by laminating two layers of Compound F sheet onto either side of one layer of Compound G sheet and electrodes were attached. Devices were cut and were processed as in Example 1 by irradiating in a first step to 25 Mrads using a 4.5 MeV electron beam at 15 mA and in a second step to 50 Mrads using a 1.5 MeV electron beam at 5 mA. The results of testing these devices at 260 VAC/10 A and 260 VAC/1 A are shown in Table II.

EXAMPLE 4

Compound H was prepared and extruded into sheet with a thickness of 0.020 inch (0.051 cm). Two sheets of Compound F were laminated on either side of one layer of Compound H to give a plaque with a thickness of 0.080 inch (0.203 cm) and, after electrode attachment, devices were cut, processed and tested following the procedure of Example 3. The results, as shown in Table II, indicate that the devices of Example 4, which comprised inorganic filler in the center, performed better than similar devices of Example 3 which had no filler.

TABLE I

| | Conductive Compositions (Volume Percent) | | | | | | | |
|---|---|---|---|---|---|---|---|---|
| Material | Cpd A | Cpd B | Cpd C | Cpd D | Cpd E | Cpd F | Cpd G | Cpd H |
| Marlex 6003 | 65.8 | 58 | 59 | 57 | 57.8 | 64 | 70 | 57 |
| Raven 600 | 34.2 | 27 | 31 | 33 | 32.2 | 36 | 30 | 28 |
| Kisuma 5A | | 15 | 10 | 10 | 10.0 | | | 15 |
| Sheet Resistivity ohm-cm | 0.9 | 2.8 | — | — | 1.0 | 0.65 | 1.7 | 1.8 |

Marlex 6003 is a high density polyethylene available from Phillips Petroleum.
Raven 600 is a carbon black available from Columbian Chemicals.
Kisuma 5A is a magnesium hydroxide available from Mitsui.

TABLE II

| Devices | Results of Electrical Testing: Number of Cycles Survived at Specified Conditions | | | | | | | | |
|---|---|---|---|---|---|---|---|---|---|
| | 260VAC/10A | | | 260VAC/3A | | | 600VAC/1A | | |
| | 90% | 50% | 30% | 90% | 50% | 30% | 90% | 50% | 30% |
| Example 1 | 24 | 76 | 82 | | | | 6 | 18 | 29 |
| Example 2 | 58 | 76 | 96 | | | | 6 | 26 | 59 |
| Example 3 | 1 | 1 | 2 | 1 | 3 | 5 | | | |
| Example 4 | 6 | 20 | 26 | 50 | 116 | >200 | | | |

EXAMPLE 5

Conductive compounds I, J, L, and M as listed in Table III were prepared using a Banbury mixer; each was pelletized. Equal quantities of Compounds I and J were blended together to give Compound K which was extruded onto a sheet with a thickness of 0.010 inch (0.025 cm). Equal quantities of Compounds L and M were blended together to give Compound N which was extruded into a sheet with a thickness of 0.020 inch (0.050 cm). A plaque was made by laminating 5 layers of Compound K on either side of a single layer of Compound N and attaching nickel foil electrodes. PTC devices were cut from the plaque and were processed following the procedure of Example 1, irradiating in the first step to 25 Mrad using a 2.5 MeV electron beam and a beam current of 10 mA, and in the second step to 150 Mrad, during which the devices reached a surface temperature of 70° C. When the finished devices were powered under 250 VAC/2A conditions, the nickel foil immediately delaminated.

EXAMPLE 6

Devices were prepared by the procedure of Example 1 except that the second irradiation step was conducted with a 2.5 MeV electron beam with a beam current of 2 mA and the devices reached a surface temperature of about 35° C. All of these devices survived 60 cycles at 250 VAC/2A and 60% of them survived 60 cycles at 600 VAC/1A.

EXAMPLE 7

Electrical apparatus made in accordance with Example 7 is shown in FIGS. 2 and 3. Conductor pads (9) made from thick film silver ink (available from ESL) were screen-printed at the edges of a 1.0×0.375×0.050 inch (2.54×0.95×0.13 cm) alumina substrate (5). A layer (6) of ruthenium oxide thick film resistor ink (ESL 3900 Series 10 ohm/sq and 100 ohm/sq blended to give a resistance of 20 ohm/sq) was printed in a pattern 0.6×0.375 inch (1.52×0.935 cm) at one edge of the alumina substrate, bridging the conductor pads. A PTC device (1) with a resistance of 2.5 ohms was attached on top of the conductor pad at the other edge via solder. Connection was made between the thick film resistor and the PTC device by means of a wire (4). Lead wires (21,22) were attached to the top surface electrode (2) of the PTC device and the edge of the thick film resistor The resulting composite device had a resistance of about 37.5 ohms.

TABLE III

| Material | Conductive Compositions (Volume Percent) | | | | | |
|---|---|---|---|---|---|---|
| | Cpd I | Cpd J | Cpd K | Cpd L | Cpd M | Cpd N |
| Marlex HXM 50100 | 54.1 | 52.1 | 53.1 | 57.1 | 55.1 | 56.1 |
| Statex G | 28.7 | 30.7 | 29.7 | 25.7 | 27.7 | 26.7 |
| Kisuma 5A | 15.5 | 15.5 | 15.5 | 15.5 | 15.5 | 15.5 |

TABLE III-continued

| Material | Conductive Compositions (Volume Percent) | | | | | |
|---|---|---|---|---|---|---|
| | Cpd I | Cpd J | Cpd K | Cpd L | Cpd M | Cpd N |
| Antioxidant | 1.7 | 1.7 | 1.7 | 1.7 | 1.7 | 1.7 |

Marlex HXM 50100 is a high density polyethylene available from Phillips Petroleum.
Statex G is a carbon black available from Columbian Chemicals.
Kisuma 5A is magnesium hydroxide available from Mitsui.
Antioxidant is an oligomer of 4,4'-thiobis (3-methyl-6-t-butyl phenol) with an average degree of polymerisation of 3–4, as described in U.S. Pat. No. 3,986,981.

EXAMPLE 8

Five sheets of Compound K were laminated between two electrodeposited nickel foil electrodes. PTC devices were cut from the plaque and were processed following the procedure of Example 6. Electrical apparatus prepared in accordance with this Example is shown in FIGS. 4 and 5.

Silver ink conductor pads (9) were screen-printed on both sides of an 0.8×0.4×0.050 inch (2.0×1.0×0.13 cm) alumina substrate (5). A ruthenium oxide thick film resistor (6) was screen-printed in a 0.8×0.3 inch (2.0×0.76 cm) rectangle on one side of the substrate. The PTC device was attached by solder to the other side. Electrical connection between the components was made by means of a screen-printed lead (4) from the bottom electrode (3) of the PTC device to one edge of the thick film resistor (6).

EXAMPLE 9

Following the procedure of Example 6, electrical apparatus was made. Two individual units were placed adjacent to one another, as shown in FIG. 8, with the PTC devices in the same plane. This packaging design allowed two units to fit into the same space on a circuit board as one unit.

EXAMPLE 10

Electrical apparatus in accordance with this Example is shown in FIGS. 9 and 8. Two PTC devices (1,1') were placed on one side of an alumina substrate (5) adjacent a voltage limiting device (30). Two ruthenium oxide thick film resistors (6,6') were screen-printed adjacent to one another on the opposite side of the substrate. Electrical connection was made between a resistor (6) and a PTC device (1) by means of a screen-printed lead (4). Electrical connection was also made between the PTC device (1) and the voltage limiting device (30) by means of another screen-printed lead (41). The second resistor (6') was connected to the second PTC device (1') by a lead (4'). The second PTC device (1') was connected to the voltage limiting device (10) by similar means (41') to the first PTC element.

EXAMPLE 11

Electrical apparatus made in accordance with this Example is shown in FIG. 11. A PTC device was made following the procedure of Example 1. Conductor pads (9,9',91,91') and a thick film resistor (6,6') were screen-printed onto one side of two alumina substrates as in Example 7. A PTC device (1) with a resistance of 2 ohms was positioned between the resistor on each substrate and attached with solder (40). Lead wires (21,22) were attached to a conductor pad (91,91') on each substrate so that, when connected to a source of electrical power, the current would flow from lead 21 through resistor 6, PTC device 1, and resistor 6'. The total resistance of the apparatus was 100 ohms.

EXAMPLE 12

Electrical apparatus of this Example is shown in FIG. 12. Two PTC devices were made following the procedure of Example 6. Two laminar substrates (5,5') were prepared as described in Example 11. A third laminar substrate (5'') was prepared by printing conductor pads and ruthenium oxide resistors (61,61') on both laminar surfaces. Using solder, the PTC devices were each positioned between a single-coated substrate (5,5') and a double-coated substrate (5''). Four lead wires (21,22,21',22') were attached to four conductor pads (91,91').

EXAMPLE 13

A thick film resistor having a resistance of 148.5 ohms was applied to one surface of an alumina substrate and a PTC device with a resistance of 1.5 ohms was attached to the opposite surface centered over the resistor. The resulting apparatus was tested and found to have a hold current of approximately 100 mA at 23° C. (60 mA at 70° C.) and a break current of 2A.

EXAMPLE 14

Electrical apparatus was prepared following the procedure of Example 13 but the PTC device was positioned on the substrate so that no part of it was over any part of the thick film resistor. The apparatus had the same hold current as that of Example 13, but had a break current of 1A.

What is claimed is:

1. A circuit protection system which comprises a PTC resistor and a second resistor which is electrically connected in series with the PTC resistor and is in thermal contact with the PTC resistor, the system having a break current $I_B$ and a hold current $I_H$, and the ratio $I_B/I_H$ being at most 20.

2. A system according to claim 1 wherein the ratio $I_B/I_H$ is at least 3.

3. A system according to claim 1 wherein the second resistor is a ZTC resistor.

4. A system according to claim 3 wherein the second resistor is a thick film resistor comprising ruthenium oxide mounted on an insulating ceramic substrate.

5. A system according to claim 1 wherein the PTC resistor is composed of a conductive polymer.

6. A system according to claim 5 wherein the PTC resistor comprises a laminar PTC element which is composed of a conductive polymer and at least two laminar electrodes.

7. A system according to claim 6 wherein at least a part of the PTC resistor does not overlap the thick film resistor when the system is viewed at right angles to the plane of the thick film resistor.

8. A system according to claim 7 wherein the plane of the PTC element is substantially parallel to the plane of the thick film resistor and the proportion of the PTC element which overlaps the thick film resistor, when the system is viewed at right angles to the plane of the thick film resistor is at most 75%.

9. A system according to claim 1 wherein the ratio $I_B/I_H$ is at most 15.

10. A system according to claim 9 wherein the ratio $I_B/I_H$ is at most 10.

11. A system according to claim 2 wherein the ratio $I_B/I_H$ is at least 5.

12. A system according to claim 11 wherein the ratio $I_B/I_H$ is at least 7.

13. A system according to claim 3 wherein the second resistor is a thick film resistor.

14. A system according to claim 8 wherein the proportion of the PTC element which overlaps the thick film resistor is at most 50%.

15. A system according to claim 14 wherein the proportion of the PTC element which overlaps the thick film resistor is at most 25%.

16. A system according to claim 15 wherein the proportion of the PTC element which overlaps the thick film resistor is 0%.

17. A system according to claim 1 wherein the total resistance of the PTC resistor and the second resistor is 5 to 200 ohms.

18. A system according to claim 3 wherein the resistance of the second resistor is at least 2 times the resistance of the PTC resistor.

19. A system according to claim 18 wherein the resistance of the second resistor is at least 5 times the resistance of the PTC resistor.

20. A system according to claim 19 wherein the resistance of the second resistor is at least 10 times the resistance of the PTC resistor.

* * * * *

UNITED STATES PATENT AND TRADEMARK OFFICE

CERTIFICATE OF CORRECTION

PATENT NO. : 5,166,658

INVENTOR(S) : Fang et al.

DATED : November 24, 1992

It is certified that error appears in the above-identified patent and that said Letters Patent is hereby corrected as shown below:

Cover Page, Assignee [73], replace "Manlo Park" by --Menlo Park--.

On Figure 2, replace "$R_2$" by --$R_3$--.

Column 1, line 40, after "four" replace "continuing" by --continuation--.

Column 6, line 4, replace "line A-A" by --line E-E--.

Column 6, line 7, replace "line B-B" by --line F-F--.

Column 6, line 12, replace "addition" by --additional--.

Column 11, lines 31 to 32, replace "a ampmeter A." should read -- an ammeter A--.

Column 11, line 34, replace "ammeter" by --ampmeter--.

Column 12, line 25, replace "line A-A" by --line E-E--.

UNITED STATES PATENT AND TRADEMARK OFFICE

CERTIFICATE OF CORRECTION

PATENT NO. : 5,166,658

INVENTOR(S) : Fang et al.

DATED : November 24, 1992

It is certified that error appears in the above-identified patent and that said Letters Patent is hereby corrected as shown below:

Column 12, line 33, replace "line B-B of FIG. 4)" by --line F-F of FIG. 6)--.

Column 12, lines 49, 54 and 58, in each occurrence, replace "device 30" by --device 10--.

Column 12, line 63, replace "layer 40" by --layer 30--.

Column 13, line 3, replace "layer 40" by --layer 30--.

Column 13, line 44, replace "ration" by --ratio--.

Column 16, line 55, replace "FIGS. 9 and 8." by --FIGS. 9 and 10.--.

Column 16, line 57, replace "device (30)" by --device (10)--.

Column 16, line 64, replace "device (30)" by --device (10)--.

Column 17, line 10, replace "(40)." by --(30).--.

Signed and Sealed this

Fifteenth Day of March, 1994

*Attest:*

Bruce Lehman

BRUCE LEHMAN

*Attesting Officer*

*Commissioner of Patents and Trademarks*